US006655674B2

(12) United States Patent
Müller

(10) Patent No.: US 6,655,674 B2
(45) Date of Patent: Dec. 2, 2003

(54) ARRANGEMENT FOR STITCHING THE SPINE OF PRINTED PRODUCTS, COMPILED OF FOLDED PRINTED SHEETS, BY MEANS OF STAPLES

(75) Inventor: Hans Müller, Zofingen (CH)

(73) Assignee: Grapha-Holding AG, Hergiswil (CH)

( * ) Notice: Subject to any disclaimer, the term of this patent is extended or adjusted under 35 U.S.C. 154(b) by 0 days.

(21) Appl. No.: 10/101,125

(22) Filed: Mar. 19, 2002

(65) Prior Publication Data

US 2002/0140155 A1 Oct. 3, 2002

(30) Foreign Application Priority Data

Mar. 29, 2001 (EP) ..... 01810321

(51) Int. Cl.[7] ..... B42B 4/02

(52) U.S. Cl. ..... 270/52.18; 270/58.08; 227/81

(58) Field of Search ..... 270/52.15, 55.07, 270/58.08; 227/81, 82, 83, 84; 412/6, 35, 39

(56) References Cited

U.S. PATENT DOCUMENTS 4,236,706 A * 12/1980 Schlough ..... 270/52.18
5,174,557 A * 12/1992 Meier ..... 270/38
5,342,032 A * 8/1994 Meier ..... 270/37
5,464,199 A * 11/1995 Stauber ..... 270/52.18
5,551,682 A * 9/1996 Luthi ..... 270/52.18
5,564,685 A * 10/1996 Reist ..... 270/52.18
5,570,832 A * 11/1996 Meier ..... 227/81
5,590,828 A * 1/1997 Stauber ..... 227/81

FOREIGN PATENT DOCUMENTS

EP 03 809 21 A2 8/1990
EP 03 809 21 B1 8/1990

* cited by examiner

*Primary Examiner*—Patrick Mackey
(74) *Attorney, Agent, or Firm*—Friedrich Kueffner

(57) ABSTRACT

An arrangement for stitching the spine of printed products, complied of folded printed sheets, by staples has a stitching device with a stitching head/bending arrangement. A conveying device for conveying the printed products to the stitching device at a spacing sequentially behind one another and with the spine transverse to the conveying direction is provided. The stitching device has a stitching support on which the stitching head/bending arrangement is arranged. The stitching support is configured to move during the stitching process approximately in the same direction and at least approximately at the same speed as the conveying device.

37 Claims, 11 Drawing Sheets

ARRANGEMENT FOR STITCHING THE SPINE OF PRINTED PRODUCTS, COMPILED OF FOLDED PRINTED SHEETS, BY MEANS OF STAPLES

BACKGROUND OF THE INVENTION

1. Field of the Invention

The invention relates to an arrangement for stitching the spine of printed products, compiled of folded printed sheets, by means of staples, wherein the printed products are transported by means of a conveying device, with the spine transverse to the conveying direction and at a spacing sequentially behind one another, to a stitching device comprised of a stitching head/bending arrangement.

2. Description of the Related Art

Devices of this kind are used, inter alia, in so-called gather-stitchers where loosely collected printed sheets are combined to printed products that are supplied to a stitching device downstream of the collecting stretch.

In newspaper production pre-products are inserted into a main product. For some time now, newspapers have issued in a tabloid format which is comprised of several parts which are stitched by staples in rotation. These printed products are considered reader-friendly and have a higher quality standard.

Such printed products could be further improved in the interest of the publisher as well as the reader such that the printed product as an entire product is stitched only once.

In the newspaper production there is also the desire for a more economic use of an insertion machine, for example, by means of the possibility of stitching inserted printed products, wherein the quality of such printed products could be further improved, for example, with a special envelope and/or a subsequent trimming of the printed products.

Devices of the aforementioned kind are described, inter alia, in Swiss patent application CH-A-667 621 and German patent document DE-B-36 45 276 as well as realized in the form of the gather-stitcher Combi Drum of the company Ferag AG, Hinwil, Switzerland. The devices used in this context for stitching printed products require a high mechanical expenditure, in particular, because each saddle-shaped support comprises a bending device so that for 40 and more supports on a drum a high expenditure results which is also noticeable in the maintenance costs.

The stitching of printed products which are inserted into pockets with their fold leading is described in German patent document DE-B-1 224 329 wherein the pockets for receiving the printed products are secured on a revolving drum in a perpendicular position and pass in the lower area of the drum a stationary stitching device which has a bending device, dipping into the pocket in a radial direction to the drum axis, and a stitching head on the opposite side interacting with the bending device. This stitching device does not allow a economic processing output because of the long travel stroke of the bending device.

SUMMARY OF THE INVENTION

It is an object of the present invention to provide a device of the aforementioned kind which no longer has the aforementioned deficiencies and which can be produced easily.

In accordance with the present invention, this is achieved in that the stitching device is embodied as a stitching support having a stitching head/bending arrangement and driven during the stitching process approximately in the same direction and at least approximately with the same speed as the conveying device.

In the following the invention will be described in the form of several embodiments illustrated in the drawings; reference is being had to the drawings in regard to all details not described specifically in the specification.

DESCRIPTION OF THE PREFERRED EMBODIMENTS

Figure 1:
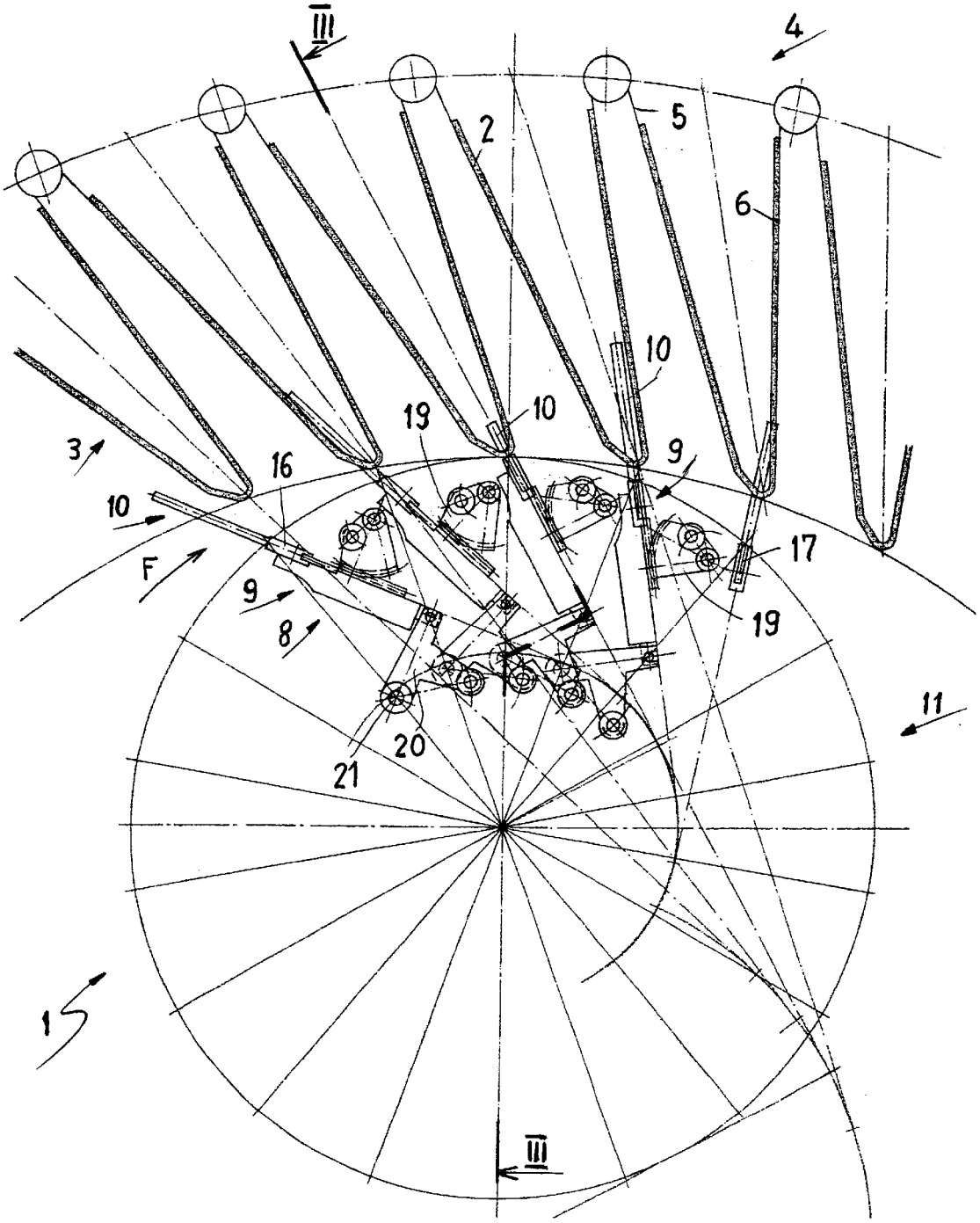
FIG. 1 shows a schematic illustration of one embodiment of the device according to the invention.

In FIG. 1 a device 1 for stitching the spine of printed products 2, which are compiled of folded printed sheets, by means of staples is illustrated, wherein the printed products 2 are inserted into insertion pockets 3 of a conveying device 4 with their fold leading. The conveyor 4 is, for example, an insertion machine in which the pre-products are inserted into a main product. This process for manufacturing newspapers is known and therefore does not require any detailed discussion. The insertion pockets 3 are fastened on both ends on circulating chains and have means for opening and keeping open the printed products supplied thereto. In the illustrated situation, the legs of the printed sheets inserted into one another rest against the walls 5, 6 of the pockets 3. The pockets 3 are, for example, embodied like those described in European patent application 0 475 192 A2. Supports of the printed products in the insertion pockets 3 are embodied as height-adjustable brackets (pocket bottom elements) forming the bottom of the insertion pockets 3 which are matched to the format of the printed products. As a result of the varying fold thickness of the printed products 2, it may be advantageous when the stitching support 7 or the conveying device 4 is adjustable relative to the outer fold edge of the printed products 2 so that the fold in the transition area of the insertion pocket 3 or support to the stitching support 7 is not bent. The pocket bottom elements are inwardly staggered so that the stitching heads 9 and bending devices 10 can cooperate unimpairedly. The insertion pockets 3 are suspended from a conveying chain circulating in a guide and the lower end is arranged to be leading so that the insertion pockets have a backwardly slanted position. This position however is of no relevance to the device of the invention. In the area of the pockets 3, the conveying device 4 passes a stitching support 7 arranged underneath which rotates at the tangential contact point in the same direction and at the same speed as the conveying device 4, wherein on the circumference of the stitching support 7 a stitching head/bending arrangement 8 is provided which is comprised of several paired cooperating stitching heads 9 and bending devices 10 which are correlated with a passing insertion pocket 3; this means that the stitching support 7 advantageously has a smaller number of stitching head/bending pairs than the number of insertion pockets 3 on the conveying device 4. FIG. 1 shows that the conveying device 4 has a curved course relative to the stitching device 1. The reason for this are the constructive height which, as a result of the required access for the operating personnel, must be adjusted ergonomically, as well as a stitching stretch where the stitching process is performed and which is to be optimally configured. This is described in German patent document DE-B-36 45 276.

Figure 2:
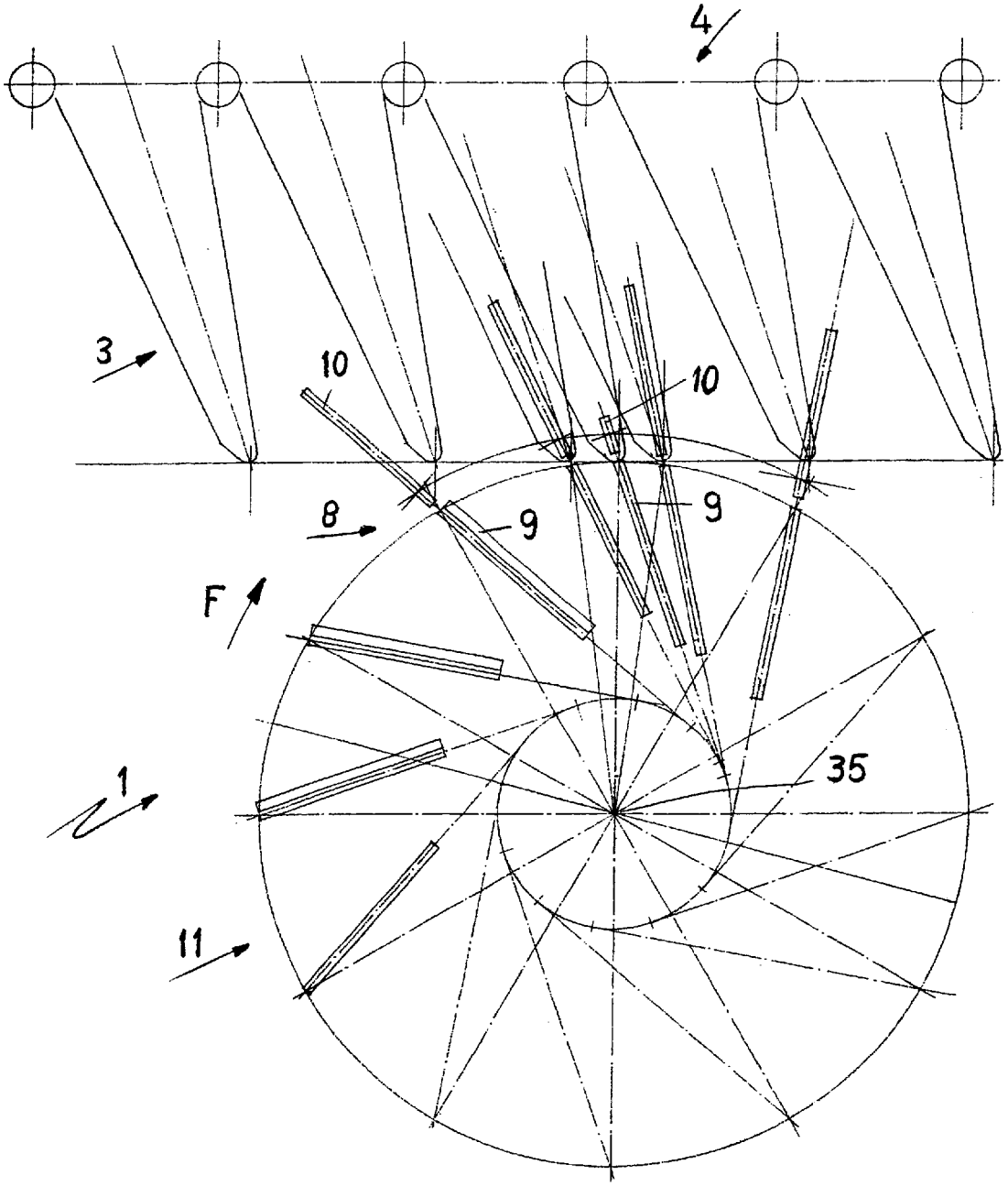
FIG. 2 is a schematic illustration of an alternative embodiment.

Of course, it is also possible, as illustrated in FIG. 2, to position the conveying device 4 horizontally tangentially in the area of the stitching device 11. In FIG. 2, it is shown that the stitching angle of the bending device 10 between the immersion into and the pivoting out from the insertion pocket 3 is smaller than for a curved conveying device 3 so that there is also less time available for stitching.

FIG. 1 also discloses the relative course of the insertion pocket 3 and of the stitching head/bending arrangement 8. In this connection, reference is being had also to FIG. 3 which shows a cross-section of the stitching device 11 in the insertion pocket area. The stitching device 11 is arranged respectively in the lateral area of the passing insertion pocket 3. On a drive shaft 12, which is supported on the machine frame 13 and is driven synchronously with the cycle of the conveying device 4, the stitching support 7 is fastened on which a stitching head/bending pair is fastened on each side, respectively. In the illustrated embodiment, the stitching support 7 is comprised of two outer disks 14 on which the bending devices 10 are fastened and two oppositely positioned inner stitching head disks 15 on which the stitching heads 9 correlated with the bending devices 10 are fastened, respectively. According to FIG. 7 wire sections, cut to size with a dispensing device 48, are transmitted by means of follower 49 to the stitching head 9 and, during this transfer, are shaped by a bending member 16 arranged on the stitching head 9 to a C shape (see also European patent application EP 0 629 515 A1). The thus prepared staple is subsequently pushed by a driver 17 of the stitching head 9 through the fold of the printed product 2 and bent on the opposite side by an anvil 18 of the bending device 10. The actuation of the driver 17 is realized by a tooth segment 19 which is driven by a control curve 23 (FIG. 3).

Since the stitching process lasts for a certain duration and therefore results in a certain stitching stretch, it is advantageous when the bending member 16 has already contact with the sheet before penetration of the staple. For this reason, the bending member 16 guiding the staple into the stitching area could be prematurely brought into sheet contact for which purpose a lever 20 is provided, respectively, which is controlled by a curve 22 and which acts on the bending member 16. The levers 20 are pivotably supported on an axle 21 and are connected at their free end with the bending member 16. This technical detail is also illustrated in FIG. 3.

In FIG. 1 it is also shown that the stitching head 9 and the bending device 10 are cooperating in a common stitching plane. FIG. 1 shows several sequences of a stitching process. In the 11 o'clock position of the stitching support 7, the stitching head 9 and the bending device 10 are in an inoperative position, as illustrated in FIG. 3 at the bottom. A sequence step later, these members are still in the initial position but a few degrees later, or immediately thereafter, the driver 17 (and the bending member 16) as well as the bending device 10 are activated by their correlated control curves 22, 23, 24. In the 12 o'clock position, which is also illustrated in FIG. 3, the staple has penetrated the fold and is bent. From this time on, the driver 17, and, if activalable, also the bending member 16, and the bending device 10 leave the closing position. Decisive on the path into the stitching position is that the anvil 18 of the bending device 10 dips into an insertion pocket 3 without damaging the printed product 2 contained therein; the exit of the anvil 18 from the insertion pocket 3 must be determined as precisely—however, these are no difficult prerequisites for a successful functioning. A wedge-shaped pocket shape is beneficial for this purpose in that the common stitching plane of the stitching head 9 and bending device 10 extends tangentially to a concentric circle within the stitching circle wherein the stitching plane at the point of staple penetration up to the final closing of the staple extends approximately through the longitudinal center area of an insertion pocket 3 (see FIG. 1).

Figure 3:
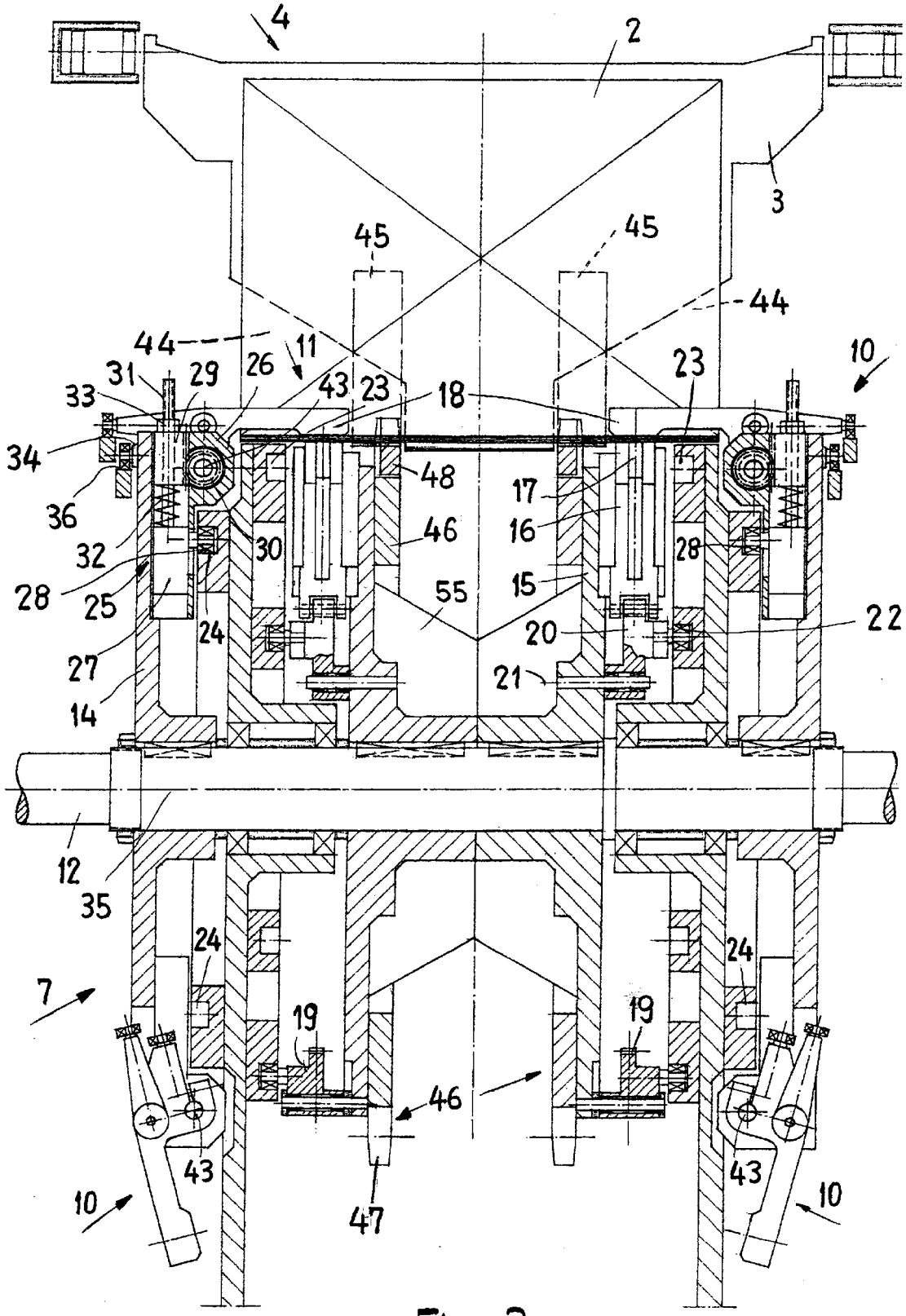
FIG. 3 is a cross section along the line III—III of FIG. 2.
Figure 5:
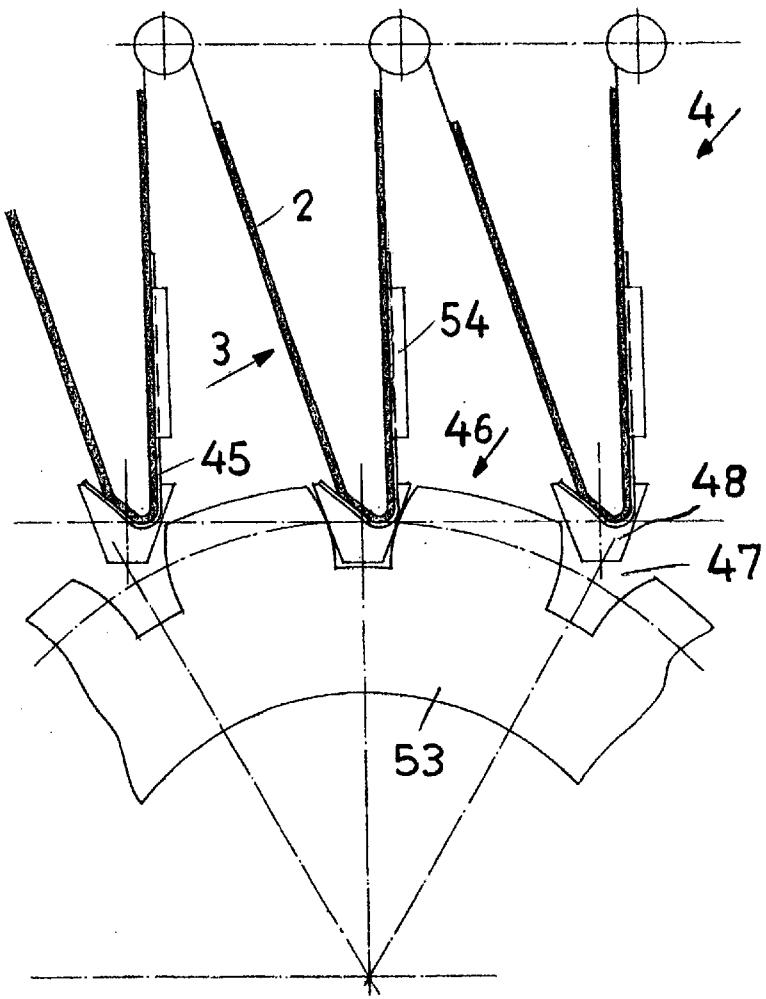
FIG. 5 shows the stabilizing device according to FIG. 4 with changed format size of the printed products.
Figures 6, 7:
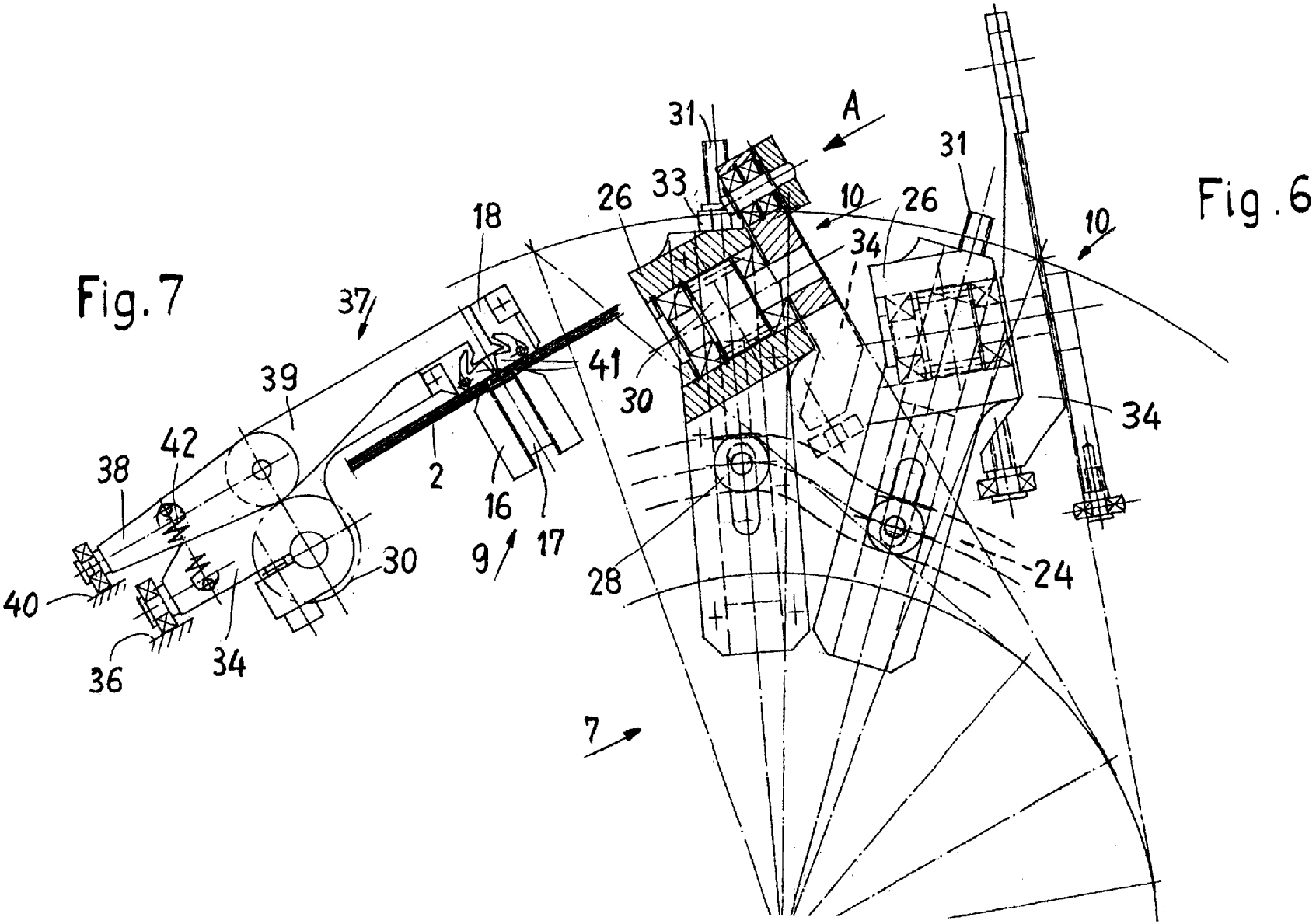
FIG. 6 shows a bending device.
FIG. 7 shows a side view of the bending device according to the direction of arrow A in FIG. 6.

The situation of the staple closure and the constructive means for this are illustrated in FIG. 3. The bending devices 10 have an anvil 18, respectively, which is pivotably supported on a support 26 forming a guide 25. In the guide 25 a sliding block 27 is connected via a roller 28 with a control curve 24 which causes a sliding block movement and actuates a tooth rack 29 which is in driving connection with the sliding block 27 and guided in the support 26. The movements of the toothed rack 29 are transmitted onto a pinion 30 which pivots the anvil 18 of the bending device 10 back and forth into the stitching position and into the initial position, respectively. In the case of an unforeseen overload, for example, when a greater thickness of the fold is to be stitched, an overload protection responds which is formed by a rod 31 penetrating the toothed rack 29 in the movement direction and a pressure spring 32 which is positioned between the sliding block 27 and the movable toothed rack 29 as well as a nut or adjusting ring 33 securing the toothed rack 29 on the rod 31. During action of the driver 17 on the anvil 18, the latter is supported by means of a lever arm 34 connected thereto on a partial support path 36 concentrically arranged to the axis of rotation 35 of the rotating stitching support 27. This arrangement is also shown in FIGS. 5 and 6. Moreover, the FIGS. 3, 6 and 7 show an additional device which is favorable in regard to the quality of the staple which ensures that the legs of the staple rest against the inner fold edge. This second bending means is integrated into the bending device 10. It is comprised of an articulated lever 37 which has a control-active lever arm 38 and an actuator arm 39. The control-active lever arm 38 moves onto a partial control curve 40 when the staple is bent and effects that the lever arm 39, connected with the wing-like bending elements 41, pivots the latter suddenly against the at least partially bent staple legs. By means of the pressure spring 42, the bending elements 41 are moved into the initial position.

FIG. 7 shows the bending device 10 as well as the correlated device, provided with pivotable bending elements 41, before lifting out of the stitching position and in the inoperative position.

At the same time, FIG. 6 shows the position of the bending device 10 in a view directed onto the side of the stitching support 7.

The left illustration shows the anvil 18 in the stitching position according to FIG. 7 and FIG. 3, upper stitching support area. As a result of the common stitching plane of the bending device 10 and the stitching head 9 which deviates from the radial direction, the toothed rack 29 and the pinion 30 have a helical gearing. The right illustration in FIG. 6 of the bending device 10 shows it in the initial position as, for example, in the lower area of the stitching support 7 in FIG. 3.

Instead of the pivot movement of the bending device 10 illustrated in the Figures, the device 10 could be moved by other advancing movements into the stitching position, for example, by a linear or a combined advancing movement wherein the movement is carried out in the stitching plane which is positioned between the walls 5, 6 of an insertion pocket 3.

The pocket bottom elements 45 forming the lower end of the insertion pocket 3 are arranged within the area between the stitching heads 9 and the bending devices 10 acting from both sides so that the latter have an unimpaired access to the stitching position. The insertion pockets 3 are advantageously configured on both sides with a recess 44. The walls 5, 6 formed by sheet metal of the suspended insertion pockets 3 form as a result of the relatively large insertion depth an unstable lower end so that a precise stitching cannot be performed reliably. For obtaining a high stability and positional precision of the insertion pockets 3 during stitching, two spaced-apart centering wheels 46 are in driving connection with the rotating stitching support 7. They have gaps 47 arranged on their periphery at a spacing corresponding to that of the insertion pockets 3 of the conveying device 4 and the insertion pockets 3, with their suspended ends or the pocket bottom brackets 45, dip in a positive-locking way into the gaps so that a high stability and sufficient precision of the insertion pockets 3 is ensured.

Figure 4:
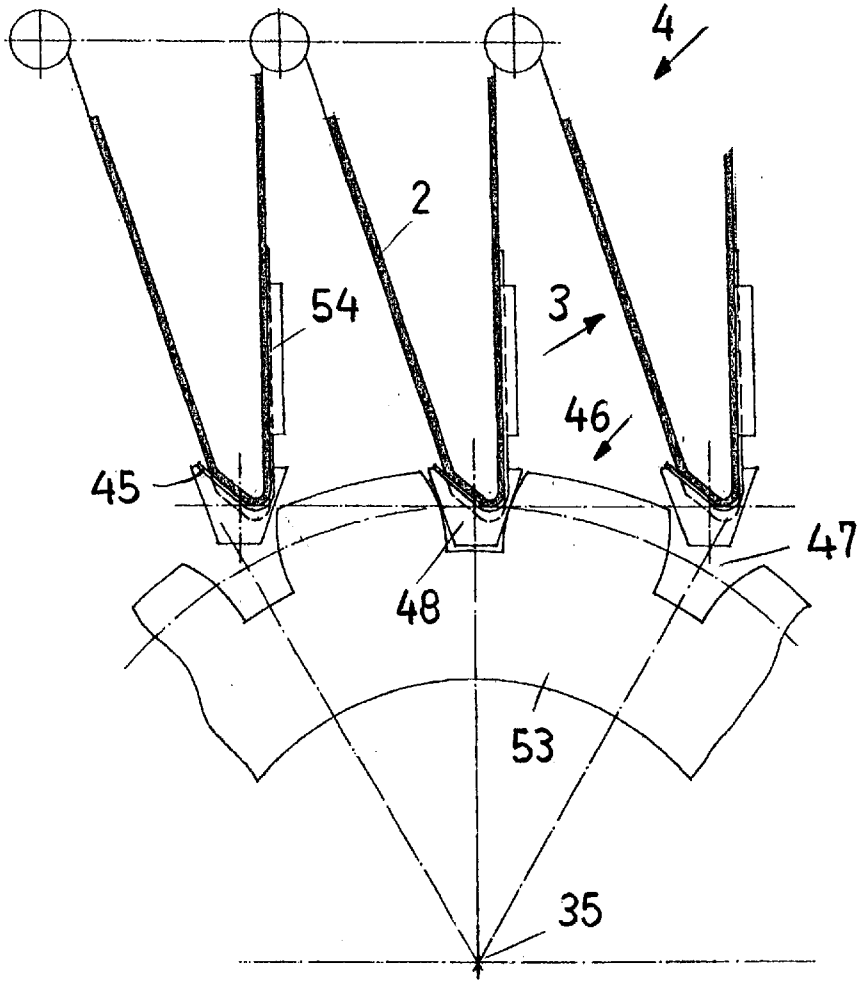
FIG. 4 is a stabilizing device.

FIGS. 4 and 5 show a stabilizing device formed of centering wheels 46 wherein the axially staggered centering wheels 46 have on their circumference gaps 47 distributed at a spacing corresponding to that of the insertion pockets 3 into which pivotable cams 46 arranged on the suspended end of an insertion pocket 3 will dip, respectively. The centering wheels 46 are formed by rings 53 screwed onto the stitching head disks 15 and provided with the gaps 47 on their outer diameter. The stitching head disks are provided with ribs 55 for reinforcement. The pocket bottom brackets 45 are guided adjustably in guides 54 and adjusted to the format of a printed product 2. FIG. 4 differs from FIG. 5 because of the different formats of the printed products, wherein in FIG. 4 a printed product 2 of a minimal width in comparison to FIG. 5 is inserted and the pocket bottom brackets 45 are adjusted in the height position such that the printed products 2 with the open lateral edges are approximately in the same position in order to be opened via a gripping fold and to be removed from the insertion pocket 3.

As a result of the height adjustability of the pocket bottom brackets 45, the stitching support 7 must be adjustable, i.e., the latter is configured to be adjustable relative to the passing pocket bottom brackets 45 in regard to its height, as illustrated in FIGS. 4 and 5.

Of course, it would be possible constructively to arrange the stitching support 7 stationarily in this respect and to make the conveying device 4 adjustable in the stitching area; however, this appears to be more cost intensive.

Figure 9:
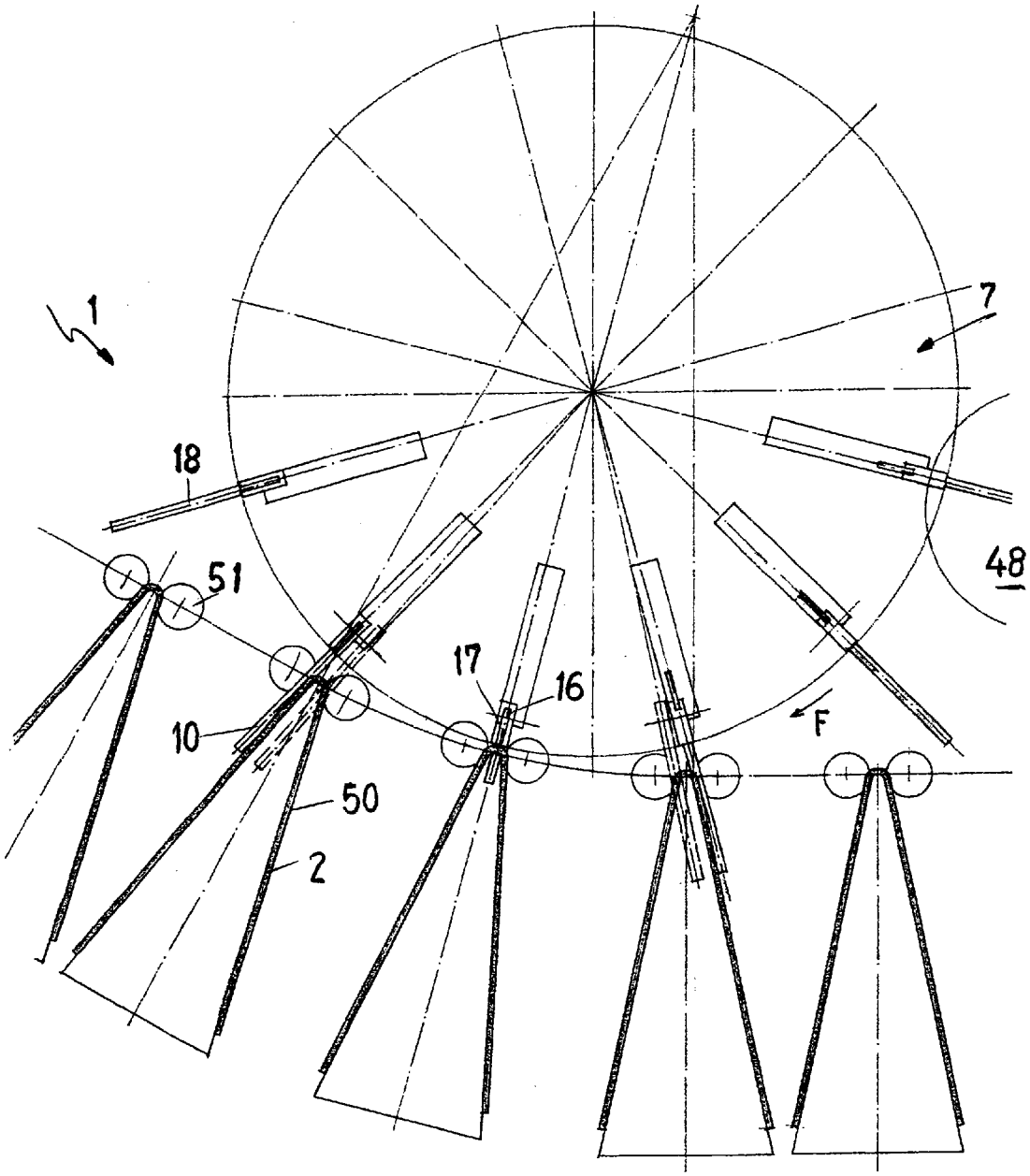
FIG. 9 shows stitching of the printed products with the device according to the invention on saddle-shaped supports.

In FIG. 9, the device 1 according to the invention is shown in cooperation with a conveying device 4 which supports the printed products 2 astraddle on saddle-shaped supports 50, wherein the conveying device 4 is a so-called ladder principal as disclosed, for example, in European patent document EP-A-0 095 603.

Of course, the inventive device 1 can also be used with a so-called drum gather-stitcher instead of those described in European patent documents EP-A-0 399 317, 0 476 718, 0 546 326, 0 569 887, 0 606 555 with significantly reduced constructive expenditure. With respect to FIG. 9, the printed products 2 are transported on supports 50 oriented transversely to the conveying direction F. The supports 50 are secured on lateral rollers 51 guided in connecting link guides and extend approximately tangentially relative to a stitching circle defined by a stitching head/bending arrangement 8 fastened on a stitching support 7. As already noted in connection with FIG. 2, a straight tangent would result in a shorter stitching stretch. FIG. 9 shows again sequences of the stitching process on the conveying device 4. In the 5 o'clock position, the stitching device 11 formed of the stitching head 9 and the bending device 10 has reached the stitching stretch where the stitching process is started. The bending member 16 loaded with a staple, if furnished accordingly, is brought into contact with the spine of the printed products 2 and directly thereafter the stitching action is started between 6 o'clock and 7 o'clock, i.e., the anvil 18 of the bending device 10 is moved or pivoted into the stitching position and the stitching stroke of the driver 17 is triggered. As described above, the bending device 10 can be provided with actuatable bending elements 41 which exert an additional movement onto the staple legs.

Figure 8:
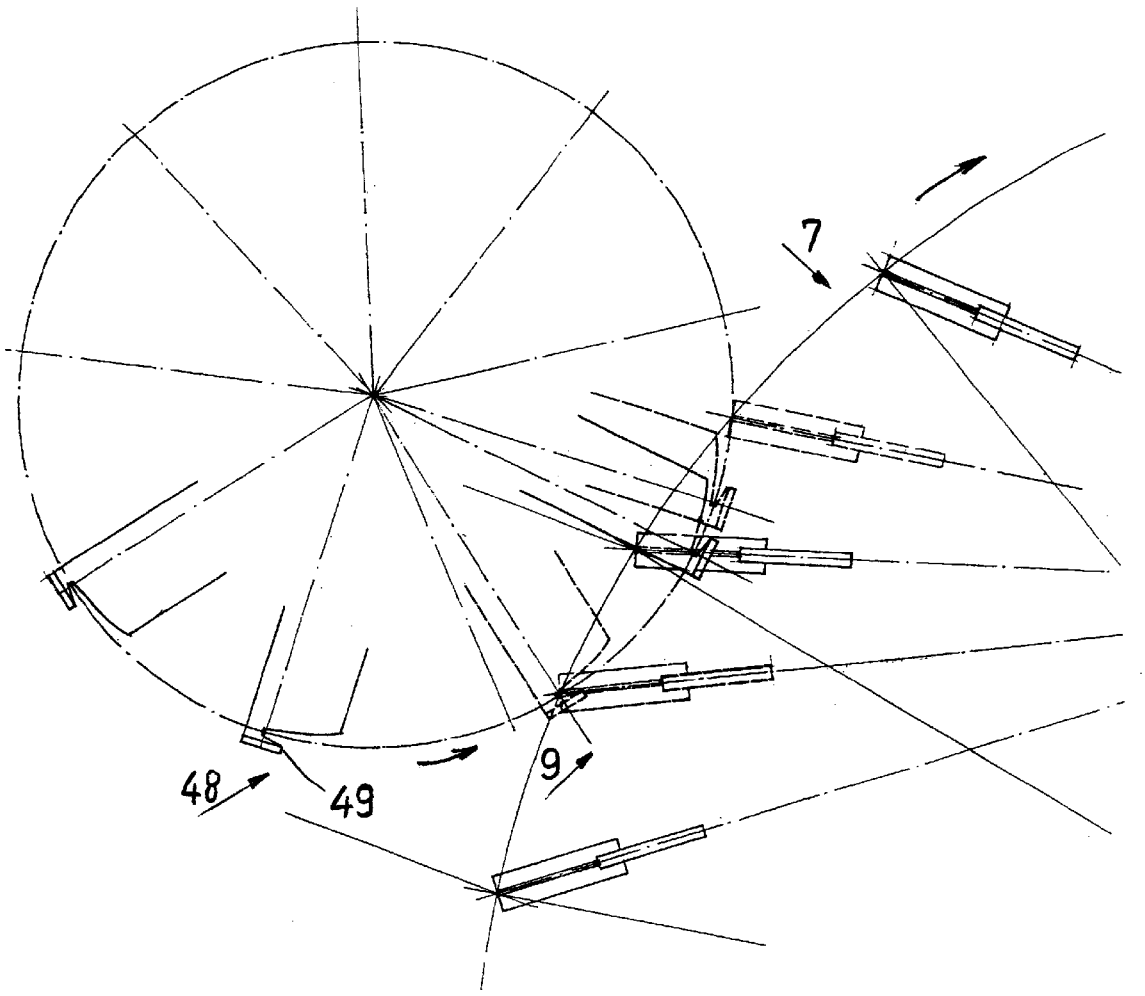
FIG. 8 shows a stitching wire supply device.

Moreover, FIG. 8 illustrates a wire section dispenser 48 which shapes the cut-off wire sections upon transfer to the stitching heads 9 or the bending member 16.

Figure 10:
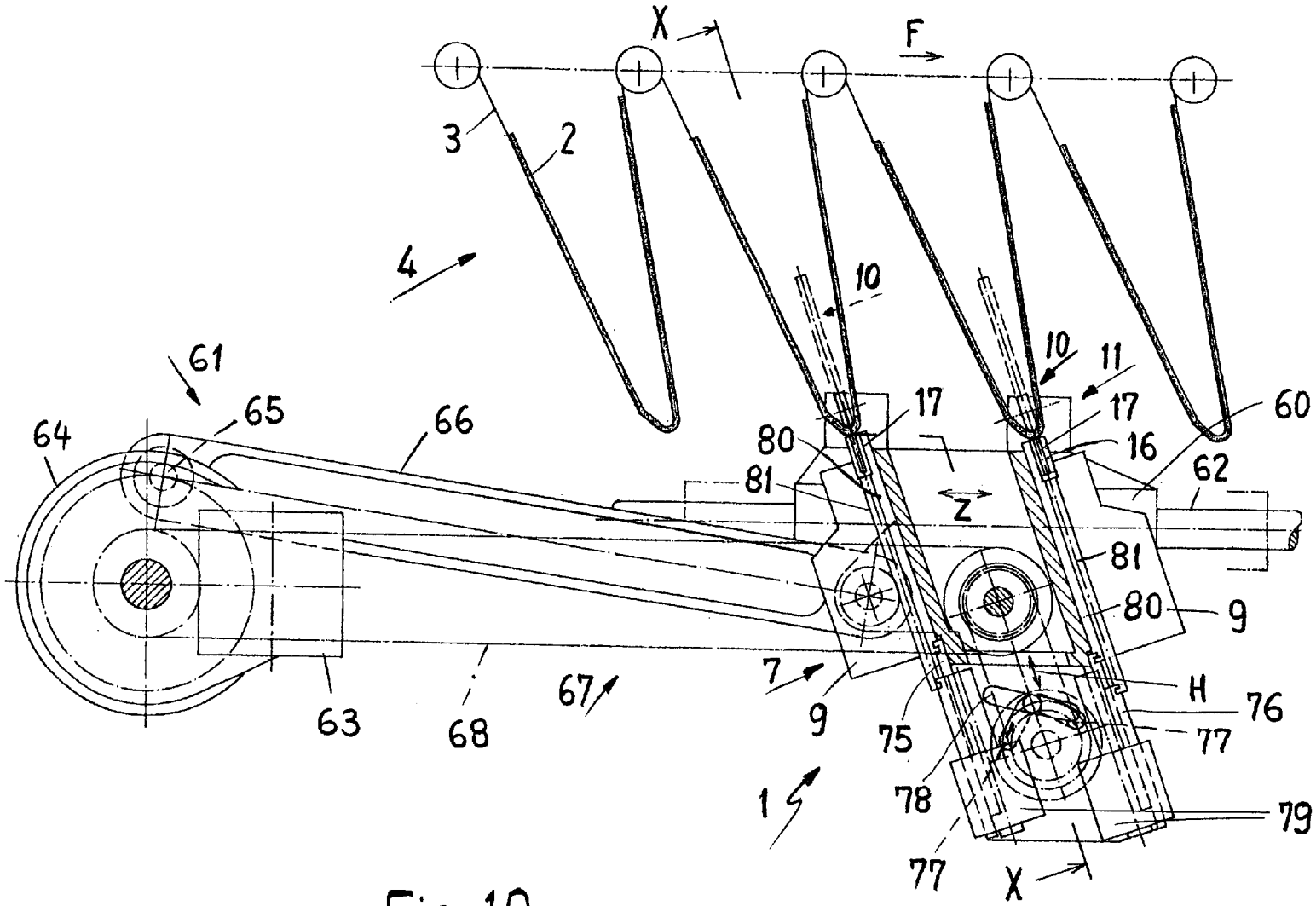
FIG. 10 shows a schematic illustration of an alternative embodiment of the device according to the invention.
Figure 11:
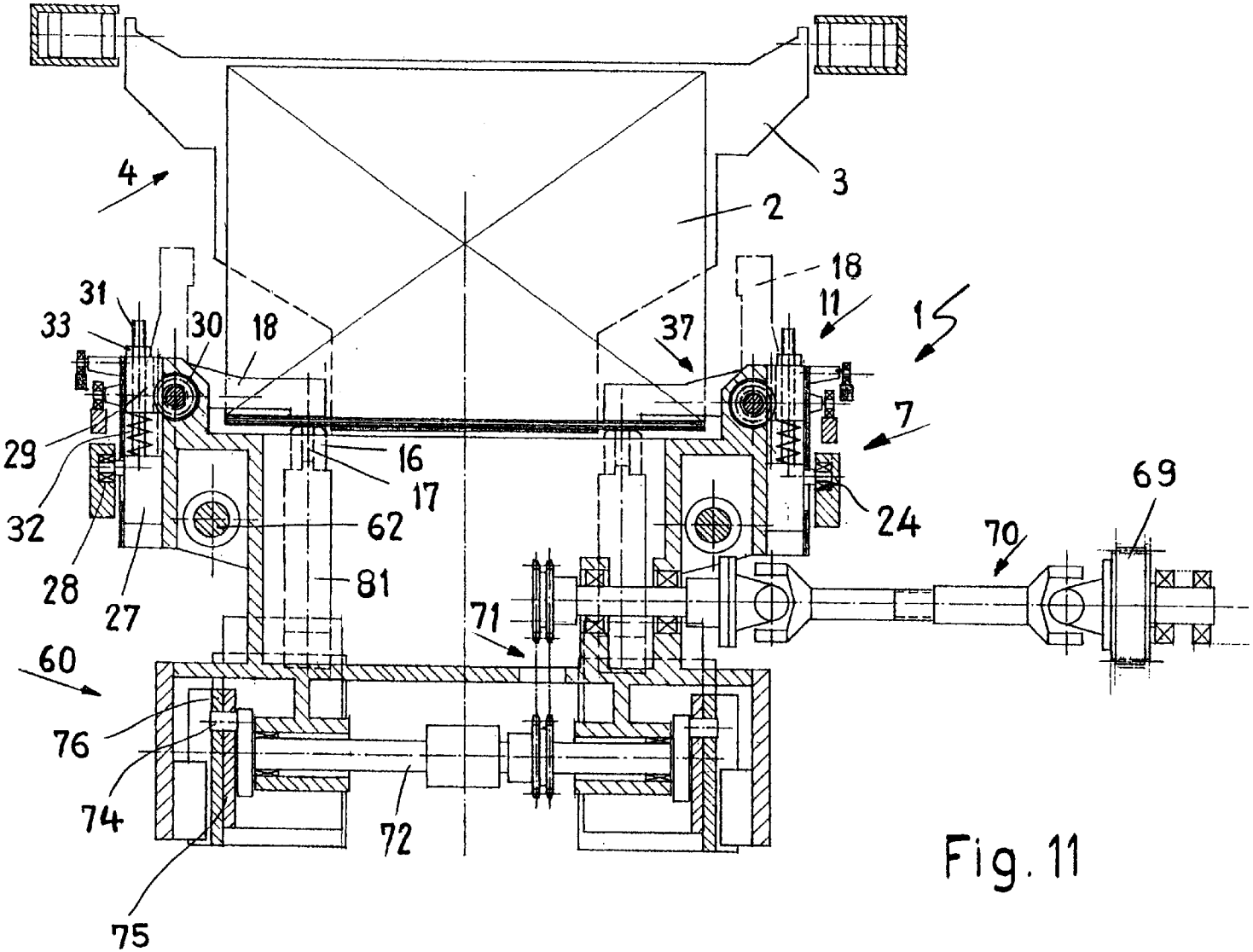
FIG. 11 shows a cross-section along the line X—X in FIG. 10.

An alternative device 1 according to the invention is illustrated in FIGS. 10 and 11 which can be used in connection with inserted printed products as well as with printed products which are transported astraddle on a support. The illustrated embodiment is provided for the stitching of a printed product 2 transported in insertion pockets 3. For this purpose, as already illustrated in FIG. 2, a conveying device 4 with insertion pockets 3 fastened sequentially at a spacing on a traction device is provided.

Parallel to the conveying direction F, at least along a stitching stretch on which the staples are anchored in the printed products 2, the stitching support 7 formed as a slide 60 is guided back and forth in a guide 62. This means that the stitching devices 11 aligned according to the pocket slant follow the insertion pockets 3 on the stitching stretch. For this purpose, the slide 60 is connected with a crank gear 61 which is driven by a symbolically illustrated, preferably rotary angle-controlled or rotary angle-governed electric motor 63. FIG. 10 shows a crank wheel 64, crank pin 65 and a coupling 66 connecting it and the slide 60. The active length of the guide 62 is illustrated on both sides of the slide 60 by dash-dotted lines. A double arrow Z indicates the reciprocating movement of the slide 60. The rotary angle-controlled or rotary angle-governed electric motor 63 ensures that the slide 60 or the stitching devices 11 connected thereto can follow the insertion pockets correlated with the stitching at identical speed and in the same direction. The embodiment according to FIG. 10 provides two stitching device pairs which are arranged sequentially at a spacing transversely to the conveying direction or the slide movement, wherein each stitching device pair has a stitching device 11 at the end face of an insertion pocket 3, respectively. Of course, the use of a single stitching device pair would be possible but the return stroke of the slide 60 would require higher accelerations in order to be available for the next stitching process; or, the speed of the conveying device 4 for a single stitching device pair would have to be reduced significantly. Of course, more than two stitching device pairs could be placed onto the slide 60; however, this would require the acceleration of greater masses.

When comparing this arrangement with FIG. 9, instead of the conveying device 4 with insertion pockets 3 it would also be possible to employ a conveying device 4 for stitching products 2 resting astraddle on supports 50.

With respect to FIGS. 10 and 11, the slide 60 has the same stitching head/bending arrangement 8 as already illustrated in FIGS. 1 through 8. The slide 7 provided as the stitching support 7 and the stitching head/bending arrangement 8 fastened thereon form again a unit which can be used for stitching of inserted printed products 2 as well as of printed products which are transported astraddle.

The difference resides in rotating versus linearly moved stitching supports 7. Different are the drive means for the bending member 16 and the driver 17 in the stitching heads 9 in the illustrated embodiments.

FIG. 11 illustrates in cross-section the guide 62 formed of two rods on which the slide 60 is reciprocatingly drivable perpendicularly to the drawing plane. On the slide 60, laterally to the insertion pockets 3 suspended from the guided traction means 52, two stitching devices 11 are fastened which, together with the oppositely positioned stitching devices 11, form pairs for stitching printed products 2. FIGS. 9 and 10 show oppositely positioned bending devices 10 with anvils 18 pivoted into the stitching position, which has been realized by actuation of a toothed rack 29 movable in a guide 25. The toothed rack 29 is connected with a sliding block 27 on which a roller 28 is fastened which is seated in a control curve 24. The connection of the sliding block 27 and toothed rack 29 is achieved by a connecting rod 31 on which, between sliding block 27 and tooth rack 29, a pressure spring 32 is arranged as a protection against overload. An adjusting ring or a nut 33 on the connecting rod secures the connection of the sliding block 27 and the toothed rack 29. The toothed rack 29 engages the pinion 30 supported on the slide 60 and connected fixedly with the bending device 10 in the form of an articulated lever 37 (see also FIG. 7). As already shown and described in connection with FIG. 7, in the embodiment according to FIGS. 10 and 11 a lever arm of the articulated lever 37 is provided for a positive-locking support of the actuator arm 39 or anvil 18.

The drive of the stitching heads 9 is provided in the form of a gear 67 connected with a crank wheel 64 which connects by means of a drive belt 68 to a stationarily supported drive wheel 69. Of course, other known drive means can be employed. The transmission of the movement of the gear 67 onto one or more stitching heads 9 (stitching drive) is realized first as a result of the reciprocating movement of the slide 60 by means of a telescoping universally jointed shaft 70 onto a chain gear 71 which drives a stitching head shaft 72 extending transversely to the reciprocating movement of the slide 60. On the ends of the stitching head shaft 72 supported on the slide 60 an eccentric disc 73 with an eccentric pin 74 is fastened which penetrates, parallel to the stitching head shaft 72, a bending link 75 and a driver link 76, arranged in a connecting link guide 79, which are drivingly connected with the stitching head 9. The bending link 75 connected to the bending member 16 of the stitching head 9 has a control curve which is arrow-shaped relative to the movement direction of the stitching head 9, illustrated by the double arrow H—referred to as the bending curve 78—which is penetrated by the eccentric pin 74 in the bending link 75; the driver link 76 connected drivingly with the driver 17 has a slantedly extending control curve relative to the movement direction of the stitching head 9—here referred to as driver curve 78—which penetrates behind the bending link 75 the driver link 76. The bending member 16 and the driver 17 are provided with extensions 80, 81 for connecting them to the bending 75 and driver links 76. As a result of the slanted position of the insertion pocket caused by the leading lower end thereof, the stitching device 11 is arranged accordingly, i.e., the stitching plane in which the stitching head 9 and the bending device 10 are being moved, are positioned approximately within the bisecting line of the angle which is formed by the walls 5, 6 of the insertion pocket 3. The actuation of the bending device 10 can be triggered already before the point of coinciding of the insertion pocket 3 and the stitching plane, but the anvil 18 may dip into the insertion pocket 3 only when the printed product spread open within the insertion pockets 3 provides sufficient free space.

Otherwise, the stitching process in the embodiment according to FIGS. 10 and 11 and the requirements therefor do not differ from the technical measures of the embodiments of the preceding figures.

A further discussion of FIGS. 10 and 11 is therefore not required in view of the general knowledge of a person skilled in the art.

Figure 12:
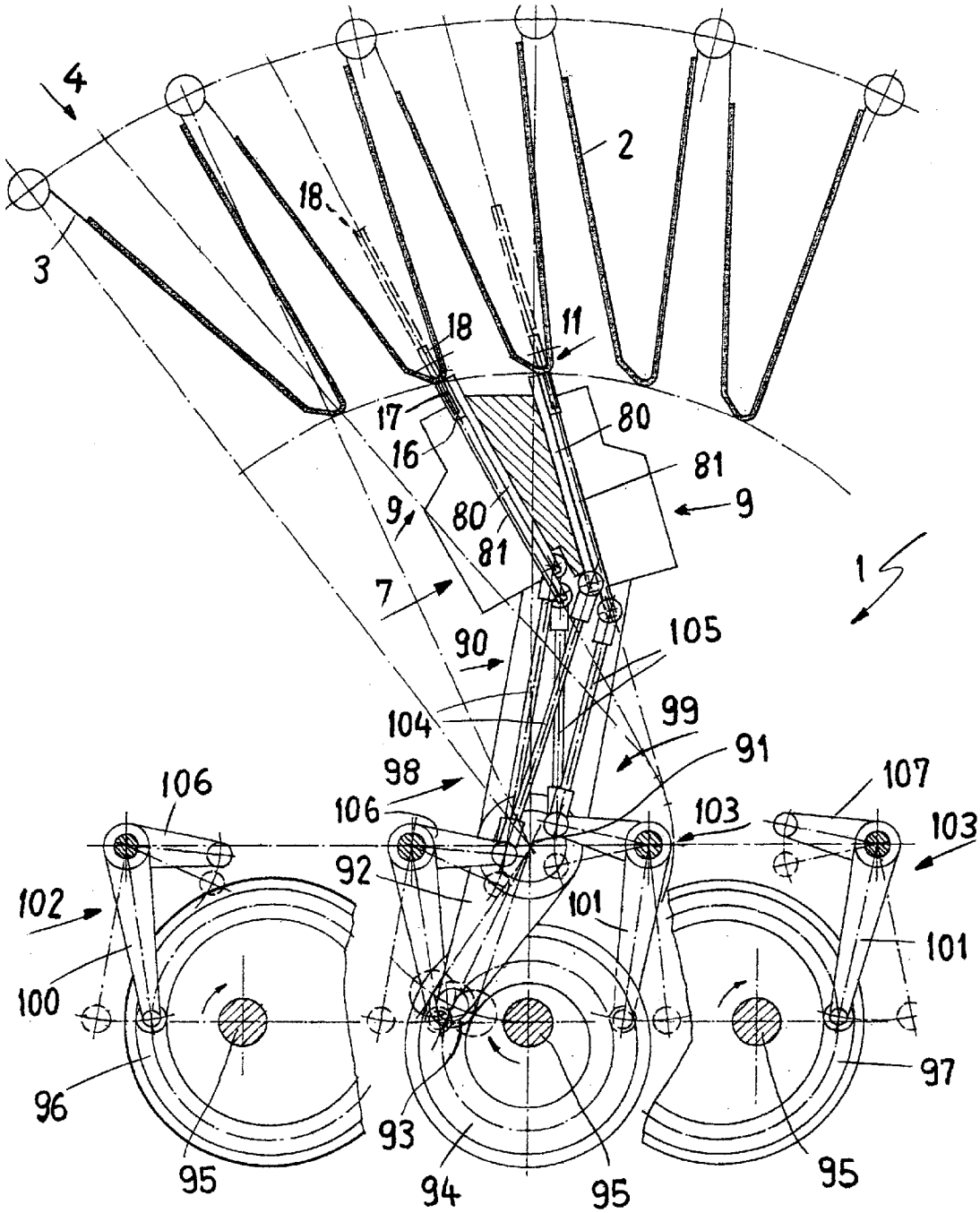
FIG. 12 is a schematic illustration of an alternative embodiment of the device according to the invention.

Another embodiment according to the invention is illustrated in FIG. 12 in which the stitching support 7 is a rocker 90 which is oscillatingly driven on the pivot axis 91. On the pivotable end of the rocker 90 two stitching device pairs of the stitching head/bending arrangement 8 are arranged, as in the embodiment according to FIGS. 10 and 11, which act stitchingly on the printed products 2 transported on a radially curved path in the insertion pockets 3 of a conveying device or in the insertion pockets 3. The pivotably reciprocating stitching heads 9 and the lower end of the insertion pockets 3 moved on the path or the pocket bottom brackets 45 of the insertion pockets 3 form a stitching circle section on which the stitching stretch is located. The spacing of the stitching head pairs corresponds to the spacing of the insertion pockets 3 and of the pocket bottom brackets 45, respectively, on the stitching circle section. The action of the stitching devices 11 does not differ from that of the preceding embodiments. As a result of the uniform curvature of the stitching circle and the position of the insertion pockets 3 deviating from the radial direction, the stitching planes which are defined by the movement of the stitching heads 9 and the corresponding bending devices 10 have an acute angle which opens radially outwardly.

The pivot movements of the rocker 90 are performed by a lever arm 92 positioned opposite the pivot axis 91 and connected with the rocker 90 which engages with the guide roller 93, connected at its free end, a circulating endless control path 94 which is connected to a driven control shaft 95. The rotary speed of the control shaft 95 and the shape of the control path 94 are determined such that the stitching devices 9 can follow the insertion pockets 3 and their pocket bottom brackets 45, respectively, on the stitching stretch.

Endless control links 96 and 97 are moreover fixedly connected with the control shaft 95 for actuation of the bending member 16 and the driver 17 of the stitching devices, respectively. The actuation of the bending member 16 and the driver 17 is realized by the linkage 98, 99 which are coupled by a lever arm 100, 101 of an angular lever 102, 103, pivotable parallel to the control shaft 95, on the one hand, with the control links 96, 97 and with a further lever arm 106, 107, on the other hand, with links 104, 105 connecting the bending member 16 or the driver 17 of the stitching heads 9.

For a better understanding of the arrangement, the control links 96, 97 correlated with the bending members 16 and drivers 17 of a stitching head 9 are illustrated only partially on both sides of the rocker drive in FIG. 12.

Otherwise, a mutual exchange of the drive concepts between the stitching support 7 according to FIGS. 10 and 11 and the embodiment according to FIG. 11 is within the capabilities of a person skilled in the art.

Figure 13:
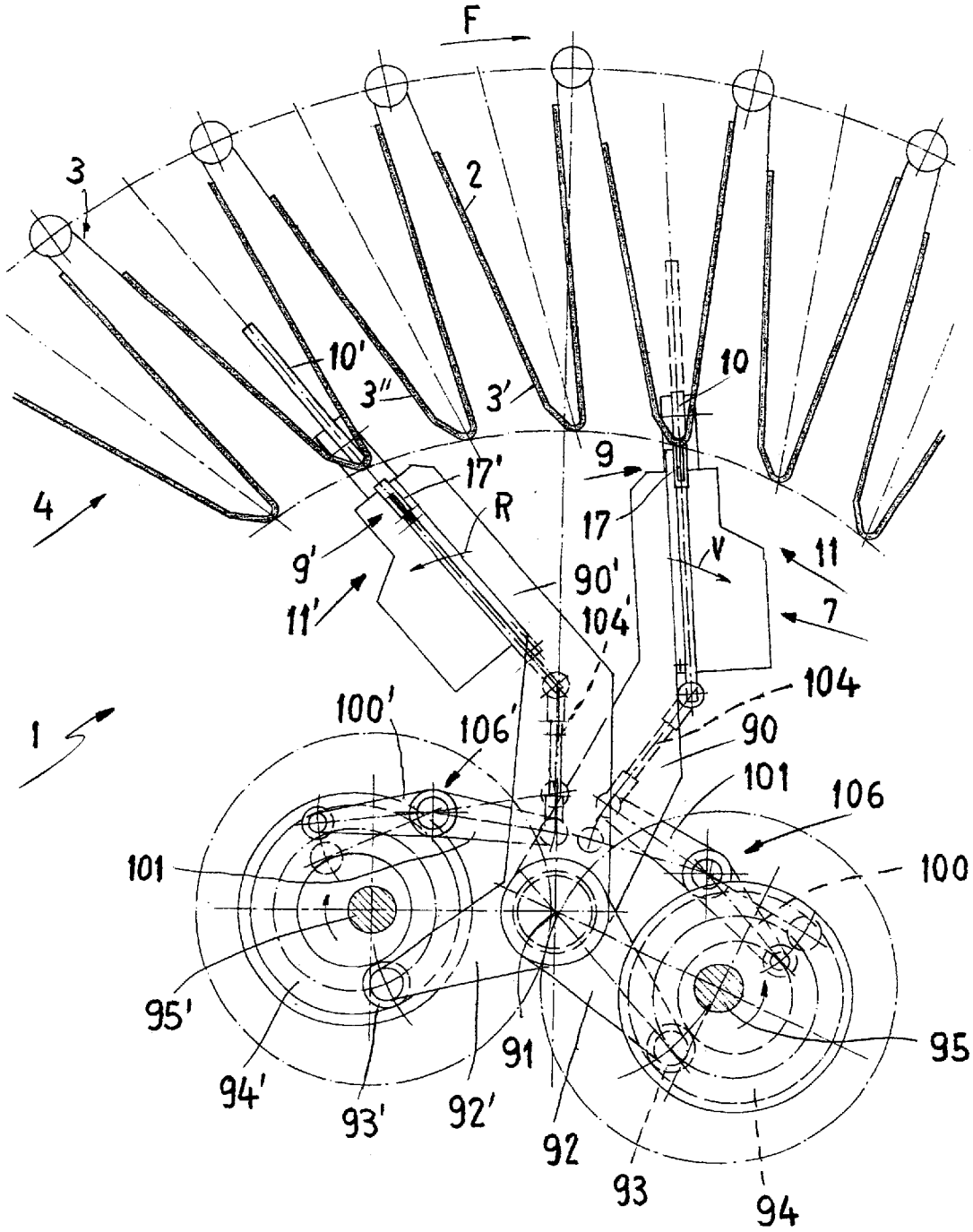
FIG. 13 is a schematic illustration of a further alternative embodiment of the invention.

FIG. 13 shows a further device 1 according to the invention. It is designed to effect a compensation of the high mass forces according to the embodiment of FIG. 12 by distributing the stitching devices 11 onto two oppositely driven rockers 90 which at their free ends are provided with a stitching device 11 correlated with a passing insertion pocket 3.

The illustration in FIG. 13 shows a situation in which the stitching device 11 is performing a stitching process and moves in the direction F with approximately the same velocity as the conveying device in the direction of arrow V. At the same time, the other stitching device 11' moves in the counter direction relative to the conveying device 4 and is on its return path, i.e., no stitching process is being performed. The inwardly pivoted bending device 10 and stitching head 9 with intermediate position of a printed product 2 demonstrates that the stitching device 11 performs a stitching process. The open position between the bending device 10' and stitching head 9' illustrates that the stitching device 11' according to arrow R is on the return path into the initial position.

Otherwise, the printed product 2' present in the insertion pocket 3' has been stapled by the stitching device 11' while the printed product 2" in the insertion pocket 3" is still to be stapled by the stitching device 11. The rockers 90, 90' have a common pivot axis 91 and are connected with lever arms 92, 92' for the actuation. The free ends of the lever arms 92, 92' are provided with guide rollers 93, 93' which engage a circulating endless control path 94, 94'. The control path 94, 94' are fastened on the drivingly connected control shaft 95. The rotational speed of the control shafts 95, 95' and the shape of the control paths 94, 94' are adjusted to the respective stitching process and return path such that the stitching devices 11, 11' during the stitching process can follow the insertion pockets 3 and, upon return, can reach the initial position at their correct point in time.

On the control shafts 95, 95' endless control links (not visible for actuation the drivers 17, 17' of the stitching devices 11, 11' are provided which are engaged by the end of a lever arm 100, 101 of a control lever 106, 106'. The lever arm 101, 101', positioned opposite the pivot axis of the control lever 106, 106', is connected by links 104, 104' with the stitching head 9, 9' of a stitching device 11, 11'. Further information can be taken from the embodiment according to FIG. 12 in which, inter alia, the bending members of a stitching head are driven.

While specific embodiments of the invention have been shown and described in detail to illustrate the inventive principles, it will be understood that the invention may be embodied otherwise without departing from such principles.

What is claimed is:

1. An arrangement for stitching the spine of printed products comprised of folded printed sheets by staples, the arrangement comprising:

a stitching device comprising a stitching head/bending arrangement;

a conveying device for conveying the printed products at a spacing sequentially behind one another and with the spine transverse to the conveying direction to the stitching device;

wherein the stitching device comprises a stitching support on which the stitching head/bending arrangement is arranged;

wherein the stitching support is configured to move during the stitching process approximately in the same direction and at least approximately at the same speed as the conveying device.

2. The arrangement according to claim 1, wherein the conveying device comprises insertion pockets or saddle-shaped supports receiving the printed products.

3. The arrangement according to claim 2, wherein the stitching support is rotatably driven.

4. The arrangement according to claim 3, wherein the stitching device and the conveying device form an overshot conveying stretch.

5. The arrangement according to claim 3, wherein the stitching support is formed as a stitching rotor and wherein the stitching head/bending arrangement is connected on a circumference of the stitching rotor.

6. The arrangement according to claim 5, wherein the stitching head/bending arrangement comprises several stitching heads, comprised of a bending member and a driver and distributed about the circumference of the stitching rotor, and further comprises controllable bending devices, wherein the stitching heads are configured to cooperating with the controllable bending devices.

7. The arrangement according to claim 5, wherein the insertion pockets or supports of the conveying device form during the stitching process a stitching stretch extending approximately tangentially to a stitching circle of the stitching voter.

8. The arrangement according to claim 5, wherein the stitching head/bending arrangement comprises a stitching head and a bending device, wherein the stitching head and the bending device form a stitching plane extending during the stitching process approximately between two walls forming the insertion pockets and tangentially to a circle which is concentrically arranged inside the stitching circle of the stitching rotor.

9. The arrangement according to claim 2, wherein the stitching support is formed by a coaxially circulating centering device having a circumference provided with gaps arranged at a spacing corresponding to a spacing between the insertion pockets, wherein the insertion pockets have suspended ends engaging during the stitching process the gaps positive-lockingly, respectively.

10. The arrangement according to claim 6, comprising:

a wire supply device supplying wire sections cut from an endless wire;

a follower configured to transfer the wire sections in cooperation with the stitching rotor as an open staple to the bending device.

11. The arrangement according to claim 2, wherein the saddle-shaped supports of the conveying device support the printed products astraddle, wherein the stitching device and the conveying device form an undershot stitching stretch.

12. The arrangement according to claim 1, wherein the stitching support is a drivable slide, further comprising a guide on which the slide is reciprocated.

13. The arrangement according to claim 12, further comprising a crank gear and a rotary angle-controlled or rotary angle-governed electric motor driving the crank gear, wherein the crank gear is coupled to the slide for synchronizing movement of the slide and the conveying device.

14. The arrangement according to claim 12, wherein the slide is driven parallel to a conveying direction of the conveying device and has at least one of the stitching head/bending arrangements acting on one of the printed products, respectively.

15. The arrangement according to claim 1, wherein the stitching support is a rocker having a pivot axis extending transversely to a conveying direction of the printed products and configured to be oscillatingly driven about the pivot axis.

16. The arrangement according to claim 15, wherein the rocker has a pivotable end and wherein the stitching head/bending arrangement is fastened to the pivotable end, further comprising a lever arm positioned, relative to the pivot axis, opposite the stitching head/bending arrangement and connected to the stitching head/bending arrangement, wherein the lever arm engages a circulating control path.

17. The arrangement according to claim 16, further comprising a control shaft connected to the conveying device so as to be driven or controlled by the conveying device, wherein the control path is arranged on the control shaft.

18. The arrangement according to claim 17, further comprising endless control links connected to the control shaft and linkages, wherein the stitching head/bending arrangement has a stitching head with a bending member and a driver, wherein the bending member and the driver are connected via one of the linkages to one of the endless control links, respectively.

19. The arrangement according to claim 18, wherein the linkages have an angular lever, respectively, pivotable parallel to the control shaft, wherein the angular lever has a lever arm coupled with one end to the control link and with the other end to links connected to the bending device and the driver, respectively.

20. The arrangement according to claim 2, wherein the stitching support is a drivable slide, comprising a guide on which the slide is reciprocated, or a rocker, having a pivot axis extending transversely to a conveying direction of the printed products and configured to be oscillatingly driven about the pivot axis, wherein the stitching head/bending arrangement of the stitching support comprises at least two stitching device pairs, arranged in the movement direction of the stitching support sequentially at a spacing matching a spacing between the insertion pockets or the saddle-shaped supports.

21. The arrangement according to claim 2, wherein the stitching head/bending arrangement comprises a stitching head and a bending device, wherein stitching head and the bending device interact with one another in a stitching plane.

22. The arrangement according to claim 21, wherein each one of the insertion pockets is formed of two walls, wherein the stitching plane during the stitching process extends approximately between the two walls of the insertion pocket.

23. The arrangement according to claim 2, wherein the insertion pocket has a slanted position and wherein a lower end of the insertion pocket relative to an upper loading end is leading when viewed in a conveying direction of the conveying device.

24. The arrangement according to claim 2, wherein the stitching head/bending arrangement has a stitching device comprised of a stitching head and a bending device, wherein the bending device has an anvil positioned opposite the stitching head for bending during the stitching process a staple penetrating the printed product, wherein the anvil, connected to the bending device, is configured to be advanced toward the correlated stitching head from a direction of end faces of the insertion pockets or the saddle-shaped supports between legs of a printed product inserted in the insertion pocket or placed onto the saddle-shaped support.

25. The arrangement according to claim 24, wherein the stitching support is a slide or a rocker and comprises a centering device acting on the insertion pockets, wherein the centering device, during the stitching process, positive-lockingly engages the suspended ends of the insertion pockets.

26. The arrangement according to claim 1, further comprising a wire supply device for supplying endless wire, wherein the stitching head/bending arrangement comprises stitching heads connected with an end of the endless wire.

27. The arrangement according to claim 1, wherein the stitching head/bending arrangement comprises stitching heads having a driver and a bending member, wherein at least the driver of the stitching heads is driven.

28. The arrangement according to claim 1, wherein the stitching head/bending arrangement has a stitching head and a bending device, wherein the bending device has an anvil positioned opposite the stitching head for bending during the stitching process staple sections penetrating the printed product.

29. The arrangement according to claim 28, wherein the anvil is arranged pivotably about an axis arranged perpendicularly to the stitching plane.

30. The arrangement according to claim 29, further comprising an articulated lever, wherein the anvil is one leg of the articulated lever and comprises a lever arm which, relative to the pivot axis of the anvil, is supported in a partial support path.

31. The arrangement according to claim 29, further comprising a curve-controlled toothed rack drive, wherein the bending device, for pivotably actuating the anvil, is connected drivingly with the curve-controlled toothed rack drive.

32. The arrangement according to claim 31, further comprising a sliding block and a substantially vertically extending guide having a guide curve for guiding the sliding block, wherein the toothed rack drive comprises a pinion fixedly connected to the anvil and a toothed rack driving the pinion, wherein the toothed rack is connected to the stitching support via of the sliding block.

33. The arrangement according to claim 2, wherein the stitching head/bending arrangement comprises bending devices and wherein the insertion pockets have cutouts in a lateral active area of the bending devices.

34. The arrangement according to claim 33, wherein the bending devices have an anvil, wherein the insertion pockets are provided with pocket bottom elements, wherein each one of the insertion pockets has two pocket bottom elements which are arranged between the anvil of two neighboring ones of the bending devices.

35. The arrangement according to claim 1, wherein the stitching support or the conveying device is adjustable relative to an outer fold edge of the printed product.

36. The arrangement according to claim 1, wherein the stitching support is comprised of two rockers having a pivot axis extending transversely to a conveying direction of the printed products and configured to be oscillatingly driven about the pivot axis in opposite directions to one another.

37. A combination of the device according to claim 1 with a gather-stitcher or an insertion machine.

* * * * *